US006318875B1

(12) United States Patent
Hrabar et al.

(10) Patent No.: US 6,318,875 B1
(45) Date of Patent: Nov. 20, 2001

(54) ILLUMINATED NUT DRIVER

(76) Inventors: Kristin Hrabar; Frank Hrabar, Jr.; Kimberly Hrabar; Donna Hrabar, all of 127A Aberdeen Rd., Aberdeen, NJ (US) 07747

( * ) Notice: Subject to any disclaimer, the term of this patent is extended or adjusted under 35 U.S.C. 154(b) by 0 days.

(21) Appl. No.: 09/648,852

(22) Filed: Aug. 25, 2000

(51) Int. Cl.[7] ..... B25B 23/18

(52) U.S. Cl. ..... 362/119; 362/250; 362/184; 362/259

(58) Field of Search ..... 362/119, 109, 362/120, 259, 184

(56) References Cited

U.S. PATENT DOCUMENTS 6,030,092 * 2/2000 McCalla et al. ..... 362/120
6,135,608 * 10/2000 Lin ..... 362/119
6,196,696 * 3/2001 Shiao ..... 362/120

* cited by examiner

*Primary Examiner*—Alan Cariaso
*Assistant Examiner*—Ronald E. DelGizzi

(57) ABSTRACT

An illuminating nut driver system comprises a hollow torque handle, the proximal end being hollow and having threads on its interior, and the distal end having an opening with a key way therein. A cylindrical nut driver at a first end and a key member at a second end are both integral with a hollow nut driver shaft. The key member is configured for coupling with the key way of the handle for being locked against rotation. A detachable lamp/laser module is removably positionable within the handle from the proximal end with threads on the proximal end coupleable with the handle. A lamp chamber is positioned within the module facing the distal end of the handle. A lamp is detachable mounted within the lamp chamber. A laser generator is positioned adjacent to the lamp at the distal end of the module. The laser generator is mounted so that its radiation is pointed out the hollow driver shaft so it can be used as a pointer. A generally cylindrical end cap has a switch contained therein.

7 Claims, 2 Drawing Sheets

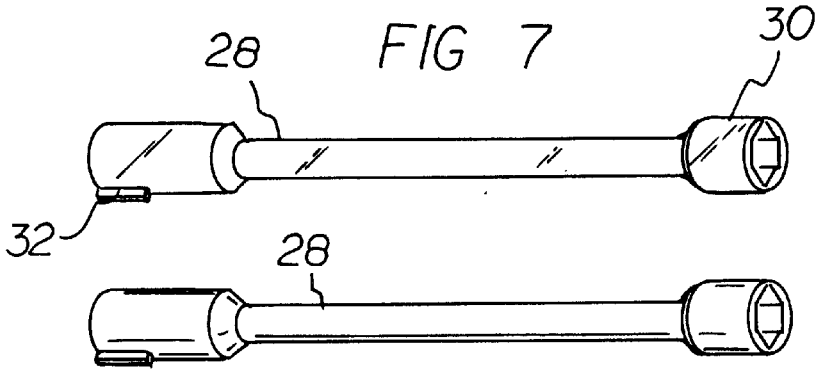
FIG 7
FIG 6
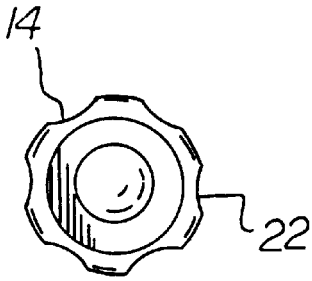
FIG 5
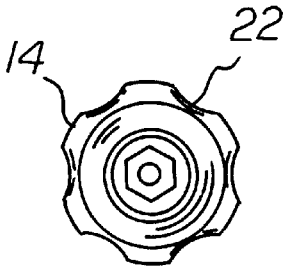
FIG 4
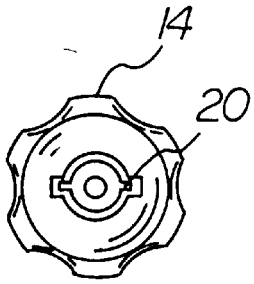
FIG 3
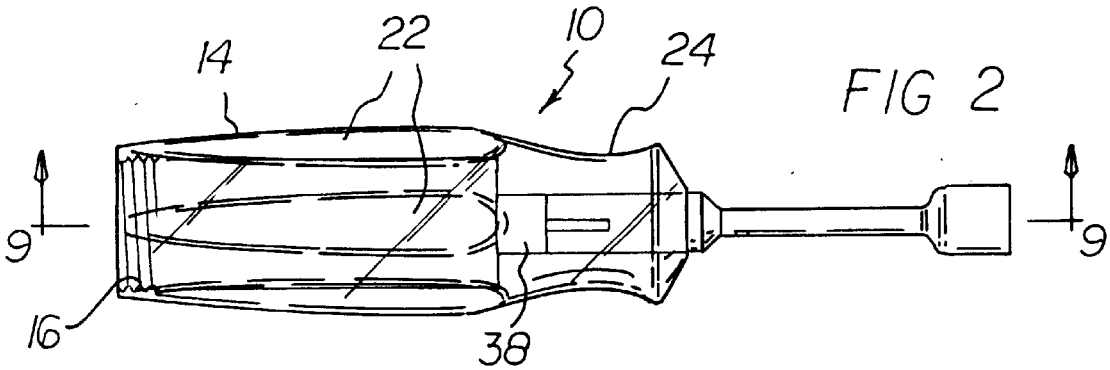
FIG 2
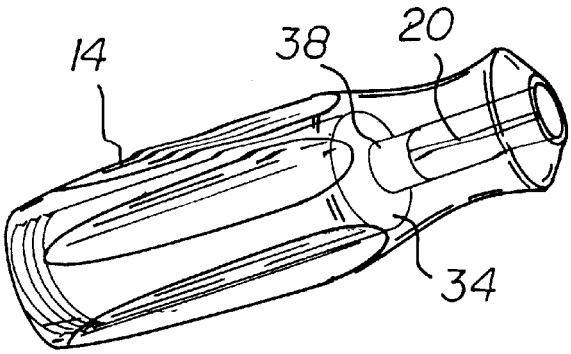
FIG 1

ILLUMINATED NUT DRIVER

BACKGROUND OF THE INVENTION

1. Field of the Invention

The present invention relates to a illuminated nut driver and more particularly pertains to lighting the area of nut placement and pointing with laser light.

2. Description of the Prior Art

The use of nut drivers of known designs and configurations is known in the prior art. More specifically, nut drivers of known designs and configurations previously devised and utilized for the purpose of illuminating work areas with tools with various method and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,628,556 to Hrabar, et al. discloses an illuminating nut driver. U.S. Pat. No. 4,283,757 to Nalbandian et al. discloses an illuminated screwdriver. U.S. Pat. No. 2,706,769 to Cook discloses a hand tool. U.S. Pat. No. 3,185,832 to Nagamori discloses an illuminated screw driver. U.S. Pat. No. 958,768 to Tong discloses hand tool holders. U.S. Pat. No. 5,211,468 to Jeng discloses a screw driver having an illuminating unit mounted thereto. U.S. Pat. No. 5,124,893 to Jeng discloses a screw driver having illuminating means mounted thereto. U.S. Pat. No. 3,919,541 to Chao discloses a screw driver's light. U.S. Pat. No. 5,690,414 discloses a screw driver adapted for use as a signaling device. U.S. Pat. No. Des. 363,012 discloses the ornamental design for an illuminating screwdriver. U.S. Pat. No. 4,989,480, to Chen discloses a screw driver having a replaceable driving head. U.S. Pat. No. 5,826,969 to Nevin discloses an illuminating screw driver. Lastly, U.S. Pat. No. 6,030,092 to McCalla, et al. discloses a light handle.

While these devices fulfill their respective, particular objectives and requirements, the aforementioned patents do not describe illuminated nut driver that allows lighting the area of nut placement and pointing with laser light.

In this respect, the illuminated nut driver according to the present invention substantially departs from the conventional concepts and designs of the prior art, and in doing so provides an apparatus primarily developed for the purpose of lighting the area of nut placement and pointing with laser light.

Therefore, it can be appreciated that there exists a continuing need for a new and improved illuminated nut driver which can be used for lighting the area of nut placement and pointing with laser light. In this regard, the present invention substantially fulfills this need.

SUMMARY OF THE INVENTION

In view of the foregoing disadvantages inherent in the known types of nut drivers of known designs and configurations now present in the prior art, the present invention provides an improved illuminated nut driver. As such, the general purpose of the present invention, which will be described subsequently in greater detail, is to provide a new and improved illuminated nut driver and method which has all the advantages of the prior art and none of the disadvantages.

To attain this, the present invention essentially comprises a hollow torque handle. The handle is formed of a clear plastic. The handle has a distal end and a proximal end. The handle also has a middle portion between the distal and the proximal end. The proximal end is hollow and has threads on its interior. The distal end has an opening. A key way is provided in the opening of the distal end. The torque handle has a generally circular cross section. The handle has a plurality of linearly extending notches. The notches have a greater radius at the distal end and taper to a lesser radius at the proximal end. A circumferential recess is provided in the handle adjacent to the distal end for enhancing the gripping capabilities of the handle. Next provided is a hollow nut driver shaft. The shaft has a cylindrical nut driver at a first end. The shaft also has a key member at a second end. The nut driver and the key member are formed integrally with the shaft. The key member of the driver shaft is configured for coupling with the key way of the handle for being locked in the key way to prevent rotation. The driver shaft is rotatably locked within the torque handle and axially slidable relative to the handle for replacement and use. The handle may have a magnet at the interior end of the key way for securement of the driver shaft or may use a clip style fastener. The magnet is annular with a central hollow passageway to allow the light to pass through the passageway. Next provided is a detachable lamp/laser module. The lamp/laser module is removably positionable within the handle from the proximal end. Threads on the proximal end are coupleable with the threads of the handle. Next provided is a lamp chamber. The lamp chamber is positioned within the module facing the distal end of the handle. A lamp is detachable mounted within the lamp chamber. A conductive strip is positioned within the lamp chamber and in electrical contact with the lamp. The conductive strip extends along an interior of the module with a contact end at the proximal end of the module. The lamp chamber includes a parabolic reflector with an opening at the distal end for the passage of light. Next provided is a laser generator positioned adjacent to the lamp at the distal end of the module. The laser generator is mounted so that its radiation is pointed out through the hollow driver shaft so it can be used as a pointer. A central electrode extends from the lower portion of the laser in contact with the conductive strip. A conductive barb is provided within the hollow torque handle in electrical contact with a second electrode of the laser. The laser generator is typically formed as a side covering of the laser. Next provided is a generally cylindrical end cap. A switch is contained within the end cap. The end cap is formed as a flexible protective resilient cover. The end cap is configured for engaging at the interior of the proximal end of the handle. The switch has a contact tip projecting from a top portion of the cap. A contact strip extends from the switch and into the end cap. The contact strip of the switch has a contact end along a shelf of the end cap. The cap is configured for allowing the contact tip to be in contact with a battery being positionable within the module wherein the contact strip of the cap is flush with the contact end of the conductive strip of the module. The contact strip of the cap is in contact with the conductive strip of the module for the passage of a current through to the lamp and laser generator. The current is passed when the switch is turned on by pushing a multi-position switch button on the cap. In this manner, when the multi-position switch button is pushed thereby allowing the battery and the lamp and/or laser generator to be in electrical contact with a battery or batteries, illumination of the lamp and laser generator, whereby light from the lamp passes from the handle around and through the driver shaft and the laser passes through the nut driver shaft.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated nut driver which has all of the advantages of the prior art nut drivers of known designs and configurations and none of the disadvantages.

It is another object of the present invention to provide a new and improved illuminated nut driver which may be easily and efficiently manufactured and marketed.

It is further object of the present invention to provide a new and improved illuminated nut driver which is of durable and reliable constructions.

An even further object of the present invention is to provide a new and improved illuminated nut driver which is susceptible of a low cost of manufacture with regard to both materials and labor, and which accordingly is then susceptible of low prices of sale to the consuming public, thereby making such illuminated nut driver economically available to the buying public.

Even still another object of the present invention is to provide a illuminated nut driver for lighting the area of nut placement and pointing with laser light.

Lastly, it is an object of the present invention to provide a new and improved illuminating nut driver system with a hollow torque handle, the proximal end being hollow and having threads on its interior, and the distal end having an opening with a key way therein. A cylindrical nut driver at a first end and a key member at a second end are both integral with a hollow nut driver shaft. The key member is configured for coupling with the key way of the handle for being locked against rotation. A detachable lamp/laser module is removably positionable within the handle from the proximal end with threads on the proximal end coupleable with the handle. A lamp chamber is positioned within the module facing the distal end of the handle. A lamp or lamps are detachably mounted within the lamp chamber. A laser generator is positioned adjacent to the lamp at the distal end of the module. The laser generator is mounted so that its radiation is pointed out the hollow driver shaft so it can be used as a pointer. A generally cylindrical end cap has a switch contained therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the illuminated handle with flashlight/laser pointer module.

FIG. 2 is a side view of the illuminated handle with interchangeable nut driver shaft and the flashlight/laser pointer module.

FIG. 3 is a top view of the illuminated handle looking through the distal end-locking piece into the handle bore.

FIG. 4 is a top view of the illuminated handle looking through the interchangeable hollow nut driver shaft into the bore of the handle.

FIG. 5 is a bottom view of the illuminated handle with the flashlight/laser pointer module.

FIG. 6 is a side view of the metal fully hollow interchangeable nut driver shaft.

FIG. 7 is a side view of the composite plastic fully hollow interchangeable nut driver shaft.

The same reference numerals refer to the same parts throughout the various Figures.

DESCRIPTION OF THE PREFERRED EMBODIMENT

Figure 8:
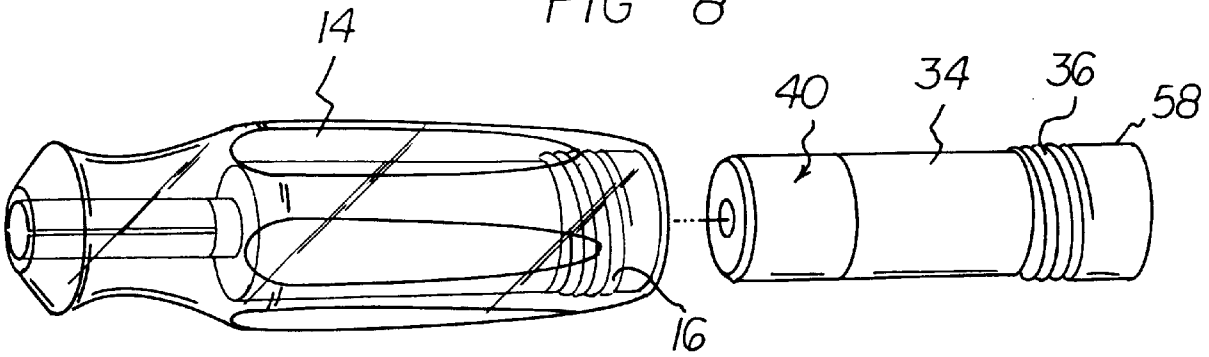
FIG. 8 is a perspective view of the illuminated handle with the flashlight/laser pointer module detached.
Figure 9:
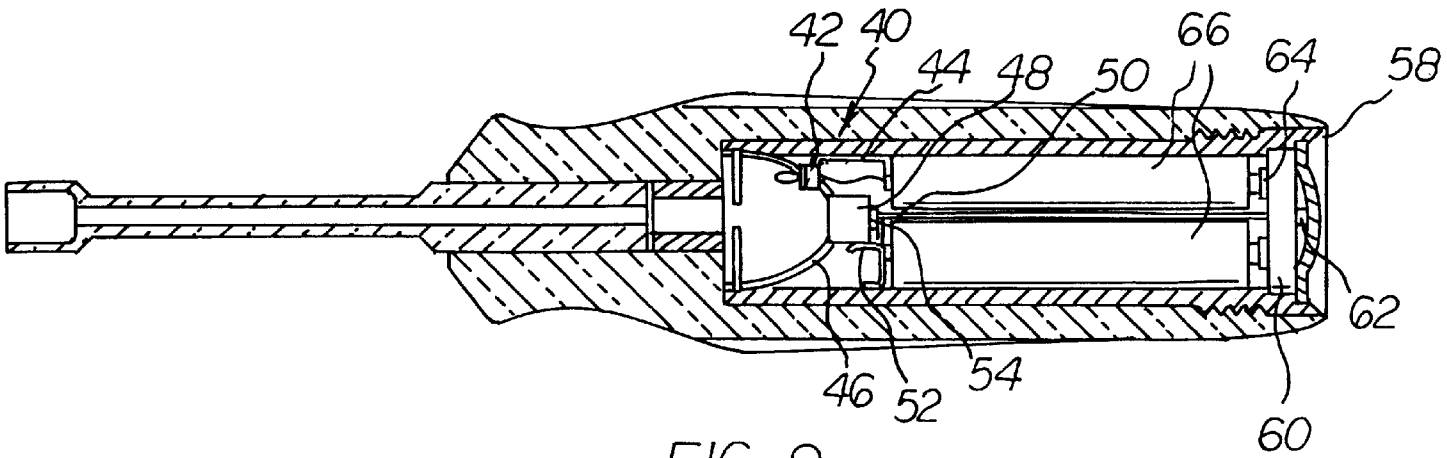
FIG. 9 is a cross sectional view of the illuminated handle with the interchangeable nut driver shaft and flashlight/laser pointer module.

With reference now to the drawings, and in particular to FIG. 1 thereof, the preferred embodiment of the new and improved illuminated nut driver embodying the principles and concepts of the present invention and generally designated by the reference numeral 10 will be described.

The present invention, the illuminated nut driver 10 is comprised of a plurality of components. Such components in their broadest context include a hollow torque handle, a hollow nut driver shaft, a detachable lamp/laser module, a lamp chamber, a laser generator, and a generally cylindrical end cap. Such components are individually configured and correlated with respect to each other so as to attain the desired objective.

First provided is a hollow torque handle 14. The handle is formed of a clear plastic. The handle has a distal end and a proximal end. The handle also has a middle portion between the distal and the proximal end. The proximal end is hollow and has threads 16 on its interior. The distal end has an opening. A key way 20 is provided in the opening of the distal end. The torque handle has a generally circular cross section. The handle has a plurality of linearly extending notches 22. The notches have a greater radius at the distal end and taper to a lesser radius at the proximal end. A circumferential recess 24 is provided in the handle adjacent to the distal end for enhancing the gripping capabilities of the handle.

Next provided is a hollow nut driver shaft 28. The shaft has a cylindrical nut driver 30 at a first end. The shaft also has a key member 32 at a second end. The nut driver and the key member are formed integrally with the shaft. The key member of the driver shaft is configured for coupling with the key way of the handle for being locked in the key way to prevent rotation. The driver shaft is rotatably locked within the torque handle and axially slidable relative to the handle for replacement and use. The handle has a magnet 38 at the interior end of the key way for securement of the driver shaft. The magnet is annular with a central hollow passageway to allow the light to pass directly through the passageway for the laser generator through the proximal end of the handle and through the aligned nut driver to exterior of the system. The nut driver shaft is preferably fabricated of metal as shown in FIG. 6. It may, however, be fabricated of composite plastic as shown in FIG. 7 in which case the magnet may be eliminated.

A detachable lamp/laser module 34 is next provided. The lamp/laser module is removably positionable within the handle from the proximal end. Threads 36 on the proximal end are coupleable with the threads 26 of the handle.

The component next provided is a lamp chamber 40. The lamp chamber is positioned within the module facing the distal end of the handle. A lamp 42 is detachably mounted within the lamp chamber. A conductive strip 44 is positioned within the lamp chamber and in electrical contact with the lamp or lamps. The conductive strip extends along an interior of the module with a contact end at the proximal end of the module. The lamp chamber includes a parabolic reflector 46 with an opening at the distal end for the passage of light.

Lastly a laser generator 48 is provided. The laser generator is positioned adjacent to the lamp at the distal end of the module. The laser generator is mounted so that its radiation is pointed out the hollow driver shaft so it can be used as a pointer. A central electrode 50 extends from the lower portion of the laser in contact with the conductive strip. A conductive barb 52 is provided within the hollow torque handle in electrical contact with a second electrode 54 of the laser. The laser generator is typically formed as a side covering of the laser.

Next provided is a generally cylindrical end cap 58. A switch 60 is contained within the end cap. The end cap is formed as a flexible protective resilient cover. The end cap is configured for engaging at the interior of the proximal end of the handle. The switch has a contact tip 62 projecting from a top portion of the cap. A contact strip 64 extends from the switch and into the end cap. The contact strip of the switch has a contact end along a shelf of the end cap. The cap is configured for allowing the contact tip to be in contact with a battery 66 being positionable within the module wherein the contact strip of the cap is flush with the contact end of the conductive strip of the module. The contact strip of the cap is in contact with the conductive strip of the module for the passage of a current through to the lamp and laser generator. The current is passed when the switch is turned on by pushing a switch button on the cap. In this manner, when the multi-position switch button is pushed thereby allowing the battery and the lamp and/or laser generator to be in electrical contact with a battery or batteries for illumination of the lamp and laser generator, whereby light from the lamp passes from the handle around and through the driver shaft and the laser passes through the nut driver shaft.

The present invention thus relates to an illuminated handle including a handle member with a distal end adapted to complementarity engage an interchangeable fully hollow nut driver shaft and which defines a bore longitudinally extending at least a portion of its length, and a flashlight module with dual illumination of a lamp and a precise laser source. The flashlight/laser module is complementarity received within the bore member so that the dual light source illuminates forward to the distal end of the handle member. The flashlight/laser module is detachably secured within the bore of the handle by complementary threaded surfaces on the flashlight/laser module and the bore of the handle. Thus, the flashlight/laser module can be used to illuminate the outdrive shafts when disposed within the handle member or used independently as a flashlight and a laser pointer. The present invention also provides for the combination of generalized illumination around and through hollow nut driver shaft, and more precise laser point of light through the hollow shaft of the nut driver.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An illuminating nut driver system for lighting the area of nut placement and pointing with laser light comprising, in combination:

a hollow torque handle of a clear plastic and having a distal end, a proximal end and a middle portion there between, the proximal end being hollow and having threads on its interior, the distal end having an opening with a key way therein, the torque handle having a generally circular cross section, the handle having a plurality of linearly extending notches having a greater radius at the distal end and tapering to a lesser radius at the proximal end, the handle further having a circumferential recess adjacent to the distal end for enhancing the gripping capabilities of the handle;

a hollow nut driver shaft formed of a composition of metal or a composite plastic or a combination of both and having a cylindrical nut driver at a first end and a key member at a second end, the nut driver and the key member being integral with the shaft, the key member of the driver shaft configured for coupling with the key way of the handle for being locked therein against rotation, the driver shaft being rotatably locked within the torque handle and axially slidable relative to the handle for replacement and use, the handle having a magnet at the interior end of the key way for securement of the driver shaft, the magnet being annular with a central hollow passageway for passage of light there through;

a detachable lamp/laser module removably positionable within the handle from the proximal end with threads on the proximal end coupleable with the threads of the handle;

a lamp chamber positioned within the module facing the distal end of the handle, the lamp chamber having a lamp detachably mounted therein, the lamp chamber having a conductive strip positioned therein and in electrical contact with the lamp, the conductive strip extending along an interior of the module with a contact end at the proximal end of the module, the lamp chamber including a parabolic reflector with an opening at the distal end for the passage of light;

a laser generator positioned adjacent to the lamp at the distal end of the module, the laser generator being mounted so that its radiation is pointed out through the hollow driver shaft so it can be used as a pointer, a central electrode extending from the lower portion of the laser in contact with the conductive strip, a conductive barb within the hollow torque handle in electrical contact with a second electrode of the laser, typically formed as a side covering of the laser;

a generally cylindrical end cap having a switch contained therein, the end cap formed as a flexible protective resilient cover, the end cap configured for engaging at the interior of the proximal end of the handle, the switch having a contact tip projecting from a top portion of the cap, the switch having a contact strip extending therefrom and into the end cap, the contact strip of the switch having a contact end along a shelf of the end cap, the cap being configured for allowing the contact tip to be in contact with a battery being positionable within the module therein the contact strip of the cap is flush with the contact end of the conductive strip of the handle, the contact strip of the cap being in contact with the conductive strip of the module for the passage of a current through to the lamp and laser generator, the current being passed when the switch is turned on by pushing a multi-position switch button on the cap, the multi-position switch button being pushed thereby allowing the battery and the lamp and/or laser generator to be in electrical contact with a battery or batteries for illumination of the lamp and laser generator, whereby light passes from the handle around and through the driver shaft and the laser passes through the nut driver hollow shaft.

2. An illuminating nut driver system comprising:

a hollow torque handle, the proximal end being hollow and having threads on its interior, the distal end saving an opening with a key way therein;

a hollow nut driver shaft having a cylindrical nut driver at a first end and a key member at a second end, the nut driver and the key member being integral with the shaft, the key member of the driver shaft configured for coupling with the key way of the handle for being locked therein against rotation;

a detachable lamp/laser module removably positionable within the handle from the proximal end with threads on the proximal end coupleable with the handle;

a lamp chamber positioned within the module facing the distal end of the handle, the lamp chamber having a lamp detachable mounted therein;

a laser generator positioned adjacent to the lamp at the distal end of the module, the laser generator being mounted so that its radiation is pointed out the hollow driver shaft so it can be used as a laser pointer; and a generally cylindrical end cap having a multi-position switch contained therein.

3. The system as set forth in claim 2 wherein the hollow nut driver shaft is formed of a composition of metal or composite plastic or a combination of both.

4. The system as set forth in claim 2 wherein the switch contained in the end cap is a multi-position switch.

5. The system as set forth in claim 2 and further including a battery or batteries within the module for illuminating the lamp and/or the laser generator.

6. The system as set forth in claim 2 wherein the laser generator is aligned with the opening of the nut driver shaft.

7. The system as set forth in claim 2 wherein the nut driver shaft is fully hollow.

* * * * *